US006408622B1

(12) United States Patent
Tsuruga et al.

(10) Patent No.: US 6,408,622 B1
(45) Date of Patent: Jun. 25, 2002

(54) HYDRAULIC DRIVE DEVICE

(75) Inventors: Yasutaka Tsuruga, Ryugasaki; Takashi Kanai, Kashiwa; Junya Kawamoto, Tsuchiura; Satoshi Hamamoto, Toyama-ken; Yasuharu Okazaki, Takaoka; Yukiaki Nagao, Toyama, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/622,957

(22) PCT Filed: Dec. 27, 1998

(86) PCT No.: PCT/JP99/07322

§ 371 (c)(1),
(2), (4) Date: Aug. 24, 2000

(87) PCT Pub. No.: WO00/40865

PCT Pub. Date: Jul. 13, 2000

(30) Foreign Application Priority Data

Dec. 28, 1998 (JP) ..... 10-374001

(51) Int. Cl.[7] ..... F15B 13/06
(52) U.S. Cl. ..... 60/422; 91/446
(58) Field of Search ..... 60/420, 422, 469; 91/516, 517, 446

(56) References Cited

U.S. PATENT DOCUMENTS 4,617,854 A 10/1986 Kropp ..... 91/517
4,967,557 A * 11/1990 Izumi et al. ..... 91/446
5,079,919 A * 1/1992 Nakamura et al. ..... 91/517
5,579,642 A 12/1996 Wilke et al. ..... 91/446
5,937,645 A * 8/1999 Hamamoto ..... 91/446

FOREIGN PATENT DOCUMENTS

| | | |
|---|---|---|
| JP | 60-11706 | 1/1985 |
| JP | 2-213524 | 8/1990 |
| JP | 10-37907 | 2/1998 |
| JP | 10-89304 | 4/1998 |
| WO | WO9637708 | 11/1996 |

* cited by examiner

*Primary Examiner*—Edward K. Look
*Assistant Examiner*—Thomas E. Lazo
(74) *Attorney, Agent, or Firm*—Mattingly, Stanger & Malur, P.C.

(57) ABSTRACT

A hydraulic drive system having a swing control system, includes a pump control unit for controlling a pump delivery rate such that a pump delivery pressure is held a predetermined value higher than a maximum load pressure among a plurality of actuators. Pressure compensating valves are each constructed to set, as a target compensation differential pressure, a differential pressure between a delivery pressure of a hydraulic pump and a maximum load pressure among the actuators. A pressure compensating valve for a swing section is given such a load dependent characteristic that when the load pressure rises, the target compensation differential pressure is reduced, the load dependent characteristic being set so as to provide a flow rate characteristic simulating constant-horsepower control of a swing motor.

6 Claims, 10 Drawing Sheets

TARGET COMPENSATION DIFFERENTIAL PRESSURE $\Delta P_{VO}$ OF PRESSURE COMPENSATING VALVE

HYDRAULIC DRIVE DEVICE

TECHNICAL FIELD

The present invention relates to a hydraulic drive system for a construction machine including a swing control system, such as a hydraulic excavator. More particularly, the present invention relates to a hydraulic drive system wherein, when a hydraulic fluid from a hydraulic pump is supplied to a plurality of actuators, including a swing motor, through respective associated directional control valves, a delivery rate of the hydraulic pump is controlled by a load sensing system and differential pressures across the directional control valves are controlled by respective associated pressure compensating valves.

BACKGROUND ART

JP, A, 60-11706 discloses a hydraulic drive system for controlling a delivery rate of a hydraulic pump by a load sensing system (hereinafter referred to also as an LS system). Also, JP, A, 10-37907 discloses a hydraulic drive system for a construction machine including a swing control system, the hydraulic drive system including an LS system and being intended to realize independence and operability of the swing control system. A 3-pump system mounted on an actual machine is also disclosed as an open-center hydraulic drive system for a construction machine including a swing control system, the hydraulic drive system being intended to realize independence of the swing control system. Further, JP, A, 10-89304 discloses a hydraulic drive system wherein a delivery rate of a hydraulic pump is controlled by an LS system and a pressure compensating valve is given a load dependent characteristic.

In the hydraulic drive system disclosed in JP, A, 60-11706, a plurality of pressure compensating valves each include means for setting, as a target compensation differential pressure, a differential pressure between a delivery pressure of the hydraulic pump and a maximum load pressure among a plurality of actuators. In the combined operation where a plurality of actuators are simultaneously driven, there may occur a saturation state that the delivery rate of the hydraulic pump is not enough to supply flow rates demanded by a plurality of directional control valves. In such a saturation state, the differential pressure between the delivery pressure of the hydraulic pump and the maximum load pressure is lowered, and correspondingly the target compensation differential pressure of each pressure compensating valve is reduced. As a result, the delivery pressure of the hydraulic pump can be distributed again in accordance with a ratio between the respective flow rates demanded by the actuators.

In the hydraulic drive system disclosed in JP, A, 10-37907 and the 3-pump system mounted on an actual machine, an independent open-center circuit using an independent hydraulic pump is constructed for a swing section, which includes a swing motor, separately from a circuit for the other actuators, whereby independence and operability of the swing control system is ensured.

In the hydraulic drive system disclosed in JP, A, 10-89304, a plurality of pressure compensating valves each have hydraulic pressure chambers constructed as follows. A pressure bearing area of a hydraulic pressure chamber, to which an input side pressure of a directional control valve is introduced and which produces a force acting in the valve-closing direction, is set to be greater than a pressure bearing area of a hydraulic pressure chamber, to which an output side pressure of the directional control valve is introduced and which produces a force acting in the valve-opening direction. The pressure compensating valve is given such a load dependent characteristic that, as a load pressure of each associated actuator rises, the target compensation differential pressure of the pressure compensating valve is reduced (i.e., the pressure compensating valve is throttled) to decrease a supply flow rate to the actuator. As a result, the actuators on both the lower and higher load sides can be operated with good operability in a stable manner without hunting. Further, a ratio of the pressure bearing area of the hydraulic pressure chamber, to which the output side pressure of the directional control valve is introduced, to the pressure bearing area of a hydraulic pressure chamber, to which the input side pressure of the directional control valve is introduced, is specified to fall in the range of 0.97– 0.94.

DISCLOSURE OF THE INVENTION

The conventional hydraulic drive systems described above however have the following problems with the swing control system.

JP, A, 60-11706: following problems ① and ②

JP, A, 10-89304: following problem ②

JP, A, 10-37907: following problem ③

Open-center 3-pump system mounted on actual machine: following problem ③

① jerky feel in operation at start-up of swing

② occurrence of energy loss, vibration, heat, etc. at start-up of swing

③ increase in cost and space and complicated circuit configuration due to provision of a separate circuit (1) JP, A, 60-11706

When the hydraulic drive system including the LS system, disclosed in JP, A, 60-11706, is applied to the swing control system, it is difficult to keep balance between load sensing control (hereinafter referred to also as an LS control) of the hydraulic pump and a flow rate compensating function of the pressure compensating valve due to an inertial load of the swing control system. This is because a difficulty occurs in keeping balance between response of the pressure compensating valve and response of the LS control for the hydraulic pump due to the following reasons when a swing driving pressure is controlled in a stage of shift from swing acceleration to steady rotation.

(1) In a swing start-up and acceleration mode, the pump LS control is performed so as to raise a delivery pressure of the hydraulic pump depending on the swing start-up pressure for holding a constant flow rate.

(2) To hold constant a differential pressure across a throttling element of the directional control valve, the pressure compensating valve is operated in a direction to increase a flow rate passing itself that tends to reduce upon a rise of the load pressure.

(3) When the swing reaches a steady speed, the swing driving pressure is lowered and therefore the pump LS control is not required to control the delivery pressure of the hydraulic pump so high as in the swing start-up and acceleration mode. Hence the pump LS control is performed in a direction to lower the delivery pressure of the hydraulic pump.

(4) Upon a lowering of the swing driving pressure, the pressure compensating valve is operated in a direction to reduce the flow rate passing itself that tends to increase.

Because of quick shift from (1) to (4), the swing operation becomes jerky (above problem ①).

Further, in the above steps (1) and (2) of the swing start-up and acceleration mode, the hydraulic fluid is supplied to the swing motor at a flow rate larger than a necessary level. As a result, the load pressure of the swing motor rises to a pressure set by an overload relief valve that serves as a swing safety valve, and a large amount of hydraulic fluid corresponding to an extra flow rate is drained to a reservoir through the swing safety valve. The extra flow rate results in energy loss, thereby deteriorating energy efficiency, and also gives rise to vibration, heat and noise (above problem ②).

(2) JP, A, 10-89304

In the hydraulic drive system disclosed in JP, A, 10-89304, since the pressure compensating valve is given a load dependent characteristic, the target compensation differential pressure of the pressure compensating valve is reduced in response to a rise of the load pressure of the swing motor when swing is solely started up, and when the swing motor shifts to a steady sate, the target compensation differential pressure of the pressure compensating valve is also returned to the original value in response to a lowering of the load pressure of the swing motor. As a result, swing can be started up without causing a jerky feel in operation. To provide the load dependent characteristic, however, the pressure bearing area ratio is specified to fall in the range of 0.97–0.94. By setting the pressure bearing area ratio in such a way, the proper load dependent characteristic is not always provided for all of different machine specifications (such as inertial load, swing device capacity, supply flow rate, and swing angular speed). In the swing start-up and acceleration mode, therefore, the swing motor is supplied with the hydraulic fluid at a considerable extra flow rate and a substantial amount of hydraulic fluid corresponding to the extra flow rate is likewise drained to a reservoir through a swing safety valve. As with the above case, the extra flow rate results in energy loss, thereby deteriorating energy efficiency, and also gives rise to vibration, heat and noise (above problem ②).

(3) Hydraulic Drive System Disclosed in JP, A, 10-37907 and Open-center 3-Pump System Mounted on Actual Machine In the hydraulic drive system disclosed in JP, A, 10-37907, the swing control system is constructed by a separate open-center circuit to ensure satisfactory swing operability in the LS system. Also, in the open-center 3-pump system mounted on an actual machine, the swing control system is constructed as a separate open-center circuit to ensure satisfactory swing operability.

More specifically, in the open-center system, when the driving pressure rises at the swing start-up, a flow rate of the hydraulic fluid returning to a reservoir through a center bypass fluid line is increased, which reduces a flow rate of the hydraulic fluid passing a throttle of the directional control valve for the swing section. A flow rate of the hydraulic fluid supplied to the swing motor is therefore restricted in the swing start-up and acceleration mode. When the swing speed reaches a steady speed, no restriction is imposed on the supply flow rate to the swing motor because of the driving pressure being not so high as at the swing start-up, and the hydraulic fluid is supplied to the swing motor at a flow rate corresponding to an opening of the throttle of the directional control valve for the swing section. The swing can be thereby smoothly started up without causing a jerky feel in operation for starting up the swing solely unlike the LS control. Also, the hydraulic fluid is suppressed from being supplied to the swing motor at an extra flow rate larger than a necessary level. In the combined operation of the swing motor and any other actuator, therefore, a part of the delivery rate of the hydraulic pump, which is saved from being supplied to the swing motor, can be supplied to the other actuator, thus resulting in more efficient and stable operation.

However, in the hydraulic drive system disclosed in JP, A, 10-37907 and the 3-pump system mounted on an actual machine, the swing control system must be constructed as a separate circuit in parallel to the system for the other actuators. Correspondingly, a cost is pushed up and a space required for installation is increased. In addition, a hydraulic pump for the swing control system must be separately provided. In the system disclosed in JP, A, 10-37907, particularly, a signal line is required to keep power balance between the swing control system and the LS system which are arranged in parallel, and hence a circuit configuration is complicated (problem ③).

An object of the present invention is to provide a hydraulic drive system including a swing control system, which enables swing operation to be accelerated for shift to a steady state without causing a jerky feel at the start-up of swing, which can realize a stable swing system with good energy efficiency, and which is free from problems resulted from providing a separate circuit, such as an increase in cost and space and complication of a circuit configuration.

(1) To achieve the above object, the present invention provides a hydraulic drive system comprising a hydraulic pump, a plurality of actuators, including a swing motor, which are driven by a hydraulic fluid delivered from the hydraulic pump, a plurality of directional control valves for controlling respective flow rates of the hydraulic fluid supplied from the hydraulic pump to the plurality of actuators, a plurality of pressure compensating valves for controlling respective differential pressures across the plurality of directional control valves, and pump control means for load sensing control to control a pump delivery rate such that a delivery pressure of the hydraulic pump is held a predetermined value higher than a maximum load pressure among the plurality of actuators, wherein the hydraulic drive system further comprises target compensation differential-pressure setting means provided respectively in the plurality of pressure compensating valves and setting, as a target compensation differential pressure, a differential pressure between the delivery pressure of the hydraulic pump and the maximum load pressure among the plurality of actuators, and target compensation differential-pressure modifying means provided in the pressure compensating valve of the plurality of pressure compensating valves, which is associated with a swing section including the swing motor, for giving the pressure compensating valve for the swing section such a load dependent characteristic that when the load pressure of the swing motor rises, the target compensation differential pressure of the pressure compensating valve for the swing section, which is set by the target compensation differential-pressure setting means, is reduced to provide a flow rate characteristic simulating constant-horsepower control of the swing motor.

By thus providing the target compensation differential-pressure modifying means in the pressure compensating valve for the swing section and giving the pressure compensating valve for the swing section the load dependent characteristic, the pressure compensating valve for the swing section performs fine adjustment of a flow rate in accordance with change in the load pressure of the swing motor at the swing start-up so that the swing motor is smoothly accelerated for shift to a steady state.

Also, by giving the pressure compensating valve for the swing section the load dependent characteristic that provides the flow rate characteristic simulating the constant-horsepower control, it is possible to carry out control such that energy per unit time supplied to the swing motor in a start-up and acceleration mode approximates an energy value in the steady state to be eventually reached. At transition from the start-up and acceleration mode to the steady state, therefore, energy required for accelerating a swing structure is ensured so as to maintain accelerating performance (acceleration feel) and useless energy is not supplied to the swing motor. Accordingly, an extra flow rate of the hydraulic fluid drained to the reservoir through an overload relief valve is reduced, whereby a stable swing system with good energy efficiency can be constructed.

Additionally, since the above-described function can be achieved without providing a separate circuit, problems of an increase in cost and space and complicated circuit configuration are avoided.

(2) In the above (1), preferably, the flow rate characteristic simulating the constant-horsepower control is such a characteristic that a flow rate resulted at the load pressure immediately after the start-up of the swing motor is substantially equal to a flow rate providing a horsepower equal to the horsepower outputted in a steady state of the swing motor.

With that feature, energy per unit time supplied to the swing motor is controlled so as to approximate an energy value in the steady state from immediately after the start-up, and satisfactory accelerating performance is achieved while a stable swing system with good energy efficiency is constructed.

(3) Also, in the above (1), preferably, the flow rate characteristic simulating the constant-horsepower control is such a characteristic that a flow rate resulted at the load pressure immediately after the start-up of the swing motor is substantially equal to a flow rate in a predetermined range set with a flow rate, as a reference, providing a horsepower equal to the horsepower outputted in a steady state of the swing motor.

With that feature, energy per unit time supplied to the swing motor is controlled so as to approximate an energy value in the steady state from immediately after the start-up, and satisfactory accelerating performance is achieved while a stable swing system with good energy efficiency is constructed.

(4) In the above (3), for example, the flow rate characteristic simulating the constant-horsepower control may be such a characteristic that a flow rate resulted at a load pressure, which is substantially middle between the load pressure in the steady state and the load pressure immediately after the start-up, is not smaller than a flow rate providing a horsepower equal to the horsepower outputted in the steady state of the swing motor.

With that feature, an extra flow rate of the hydraulic fluid drained to a reservoir is reduced with a decrease in the flow rate resulted at the load pressure immediately after the start-up of the swing motor. Therefore, effects of improving energy efficiency and enhancing stability are further increased.

Also, since the flow rate resulted at the load pressure, which is substantially middle between the load pressure in the steady state and the load pressure immediately after the start-up, is not smaller than the flow rate providing a horsepower equal to the horsepower outputted in the steady state of the swing motor, accelerating performance can be ensured.

(5) Further, in the above (1) to (3), preferably, the pressure compensating valve for the swing section has signal pressure bearing chambers on which an input sisde pressure and an output side pressure of the directional control valve for the same swing section act respectively as signal pressures, and the target compensation differential-pressure modifying means is constructed by providing an area difference between the signal pressure bearing chambers of the pressure compensating valve for the swing section and setting a pressure bearing area ratio between the signal pressure bearing chambers to provide the above flow rate characteristic.

With those features, the target compensation differential-pressure modifying means can be constructed in fully hydraulic fashion.

(6) Moreover, in the above (1) to (3), the target compensation differential-pressure modifying means may comprise means for detecting a load pressure of the swing motor, a controller for calculating a target flow rate corresponding to the detected load pressure based on a preset constant-horsepower control characteristic, and outputting a control signal corresponding to the calculated target flow rate, and means operated by the control signal for modifying the target compensation differential pressure of the pressure compensating valve for the swing section so that the target flow rate is obtained.

With those features, the target compensation differential-pressure modifying means can be constructed using a controller.

BEST MODE FOR CARRYING OUT THE INVENTION

An embodiment of the present invention will be described below with reference to the drawings.

Figure 1:
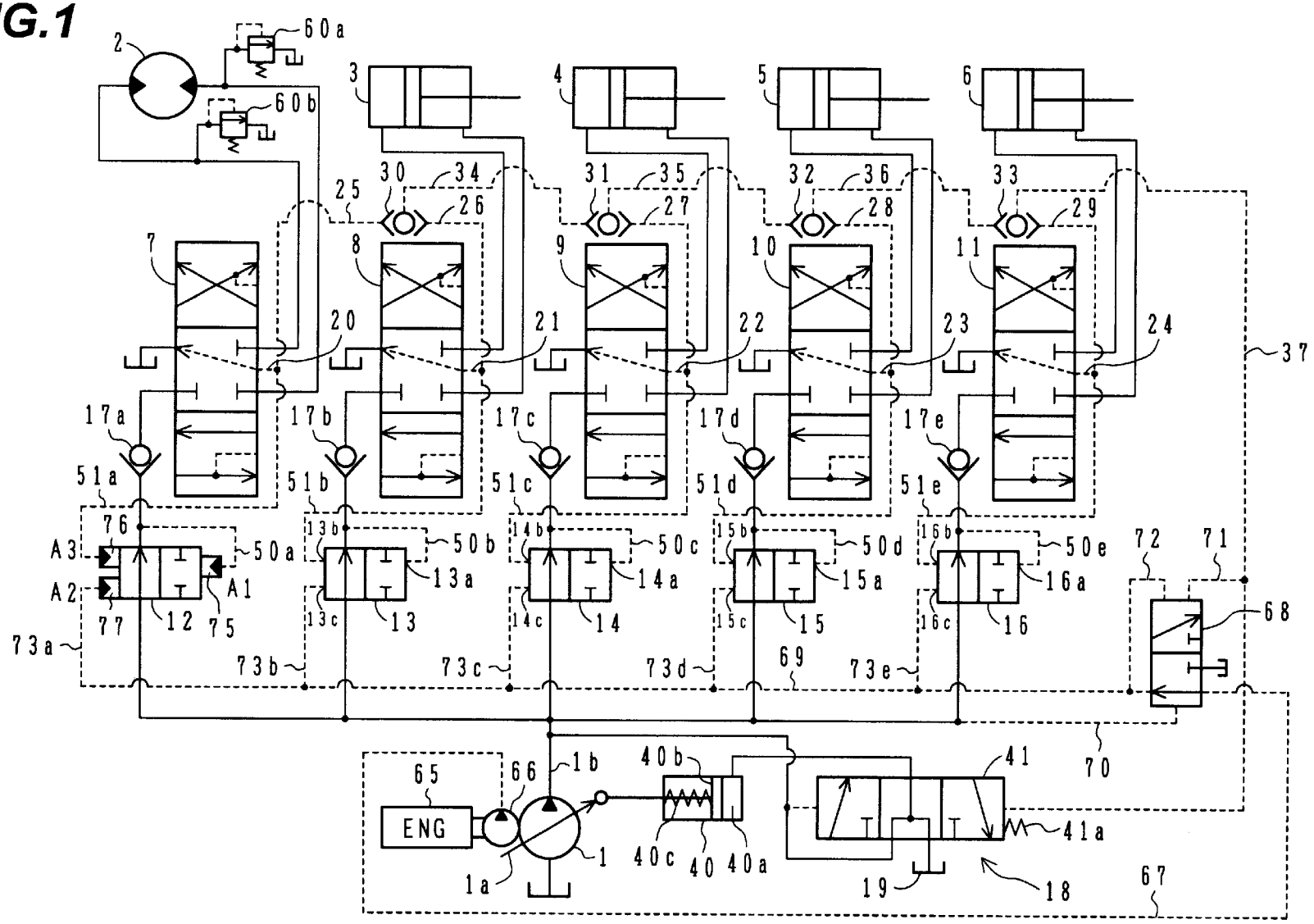
FIG. 1 is a circuit diagram showing a hydraulic drive system according to a first embodiment of the present invention.

FIG. 1 shows a hydraulic drive system according to a first embodiment of the present invention. The hydraulic drive system comprises a variable displacement hydraulic pump 1, a plurality of actuators 2–6, including a swing motor 2, which are driven by a hydraulic fluid delivered from the hydraulic pump 1, a plurality of closed-center directional control valves 7–11 for controlling respective flow rates of the hydraulic fluid supplied from the hydraulic pump 1 to the plurality of actuators 2–6, a plurality of pressure compensating valves 12–16 for controlling respective differential pressures across the plurality of directional control valves 7–11, load check valves 17*a*–17*e* disposed respectively between the directional control valves 7–11 and the pressure compensating valves 12–16 to prevent reverse flow of the hydraulic fluid, and a pump control unit 18 for load sensing control to control a pump delivery rate such that a delivery pressure of the hydraulic pump 1 is held a predetermined value higher than a maximum load pressure among the plurality of actuators 2–6. Overload relief valves 60*a,* 60*b* are provided in an actuator line for the swing motor 2. Though not shown, similar overload relief valves are provided in association with the other actuators 3–6.

The plurality of directional control valves 7–11 are provided with lines 20–24 respectively for detecting load pressures of themselves. A maximum one of load pressures detected with the detection lines 20–24 is extracted and introduced to a signal line 37 through signal lines 25–29, shuttle valves 30–33 and signal lines 34–36.

The pump control unit 18 comprises a tilting control actuator 40 coupled to a swash plate 1*a* which serves as a displacement varying member of the hydraulic pump 1, and a load sensing control valve (hereinafter referred to also as an LS control valve) for selectively controlling connection of a hydraulic pressure chamber 40*a* of the actuator 40 to a delivery fluid line 1*b* of the hydraulic pump 1 and a reservoir 19. The delivery pressure of the hydraulic pump 1 and the maximum load pressure in the signal line 37 act, as control pressures, on the LS control valve in opposite directions. When the pump delivery pressure rises beyond a total of the maximum load pressure and a setting value (target LS differential pressure) of a spring 41*a,* the hydraulic pressure chamber 40*a* of the actuator 40 is connected to the delivery fluid line 1*b* of the hydraulic pump 1 and a higher pressure is introduced to the hydraulic pressure chamber 40*a,* whereupon the piston 40*b* is moved to the left in FIG. 1 against the force of a spring 40*c*. Accordingly, the tilting of the swash plate 1*a* is decreased to reduce the delivery rate of the hydraulic pump 1. Conversely, when the pump delivery pressure lowers down from the total of the maximum load pressure and the setting value of the spring 41*a,* the hydraulic pressure chamber 40*a* of the actuator 40 is connected to the reservoir 19 and the hydraulic pressure chamber 40*a* is depressurized, whereupon the piston 40*b* is moved to the right in FIG. 1 by the force of the spring 40*c*. Accordingly, the tilting of the swash plate 1*a* is enlarged to increase the delivery rate of the hydraulic pump 1. With the above-described operation of the LS control valve, the delivery rate of the hydraulic pump 1 is controlled such that the pump delivery pressure is held higher than the maximum load pressure by an amount corresponding to the setting value (target LS differential pressure) of the spring 41*a*.

Further, a pilot pump 66 is provided and driven by an engine 65 for rotation along with the hydraulic pump 1. A differential pressure detecting valve 68 is provided in a delivery line 67 of the pilot pump 66, and its output pressure is outputted to a signal line 69. The differential pressure detecting valve 68 is a valve for producing a pressure corresponding to a differential pressure between the delivery pressure of the hydraulic pump 1 and the maximum load pressure introduced to the signal line 37 (hereinafter referred to also as an LS-differential-pressure corresponding pressure). The pressure (pump delivery pressure) in the delivery fluid line 1*b* of the hydraulic pump 1 is introduced to a spool end on the pressure raising side through a signal line 70, whereas the pressure (maximum load pressure) in the signal line 37 and an output pressure of the differential pressure detecting valve 68 itself are introduced to a spool end on the pressure lowering side through signal lines 71, 72, respectively. In response to those pressures, the differential pressure detecting valve 68 produces, from the pressure supplied from the pilot pump 66 as a primary pressure, a secondary pressure (LS-differential-pressure corresponding pressure) corresponding to the differential pressure between the pressure in the signal line 37 and the pressure in the delivery fluid line 1*b,* i.e., corresponding to the differential pressure between the pump delivery pressure and the maximum load pressure. The secondary pressure is outputted to the signal line 69.

In the pressure compensating valves 12–16, pressures upstream of the directional control valves 7–11 act in the valve-closing direction, pressures (load pressures) in the detection lines 20–24 given by pressures downstream of the directional control valves 7–11 act in the valve-opening direction, and the LS-differential-pressure corresponding pressure introduced to the signal line 69 acts in the valve-opening direction. As a result, the differential pressures across the plurality of directional control valves 7–11 are controlled by employing, as the target compensation differential pressure, a differential pressure (hereinafter referred to also as an LS-control differential pressure) between the delivery pressure of the hydraulic pump 1, which has been LS-controlled as described above, and the maximum load pressure.

For the pressure compensating valves 12–16, the pressures upstream of the directional control valves 7–11 are taken out respectively through signal lines 50*a*–50*e,* the pressures (load pressures) in the detection lines 20–24 given by the pressures downstream of the directional control valves 7–11 are taken out respectively through signal lines 51*a*–51*e,* and the pressure in the signal line 69 is taken out through signal lines 73*a*–73*e*.

Also, in the pressure compensating valve 12 in a section for the swing motor 2 (hereinafter referred to as a swing section), the pressure taken out through the signal line 50*a* is introduced to a pressure bearing chamber 75 having a pressure bearing area A1 and acting in the valve-closing direction, and the pressure taken out through the signal line 51*a* is introduced to a pressure bearing chamber 76 having a pressure bearing area A3 and acting in the valve-opening direction. Further, the pressure taken out through the signal line 73*a* is introduced to a pressure bearing chamber 77 having a pressure bearing area A2 and acting in the valve-opening direction. The pressure bearing areas A1, A2, A3 satisfy relationships of A3<A1 and A2>A1. The relationship of A3<A1 gives the pressure compensating valve 12 a load dependent characteristic simulating constant-horsepower control (described later).

Although the other pressure compensating valves 13–16 than that for the swing section also have similar pressure bearing chambers 13*a,* 13*b,* 13*c*–16*a,* 16*b,* 16*c,* all these pressure bearing chambers have the same pressure bearing area.

Figure 2:
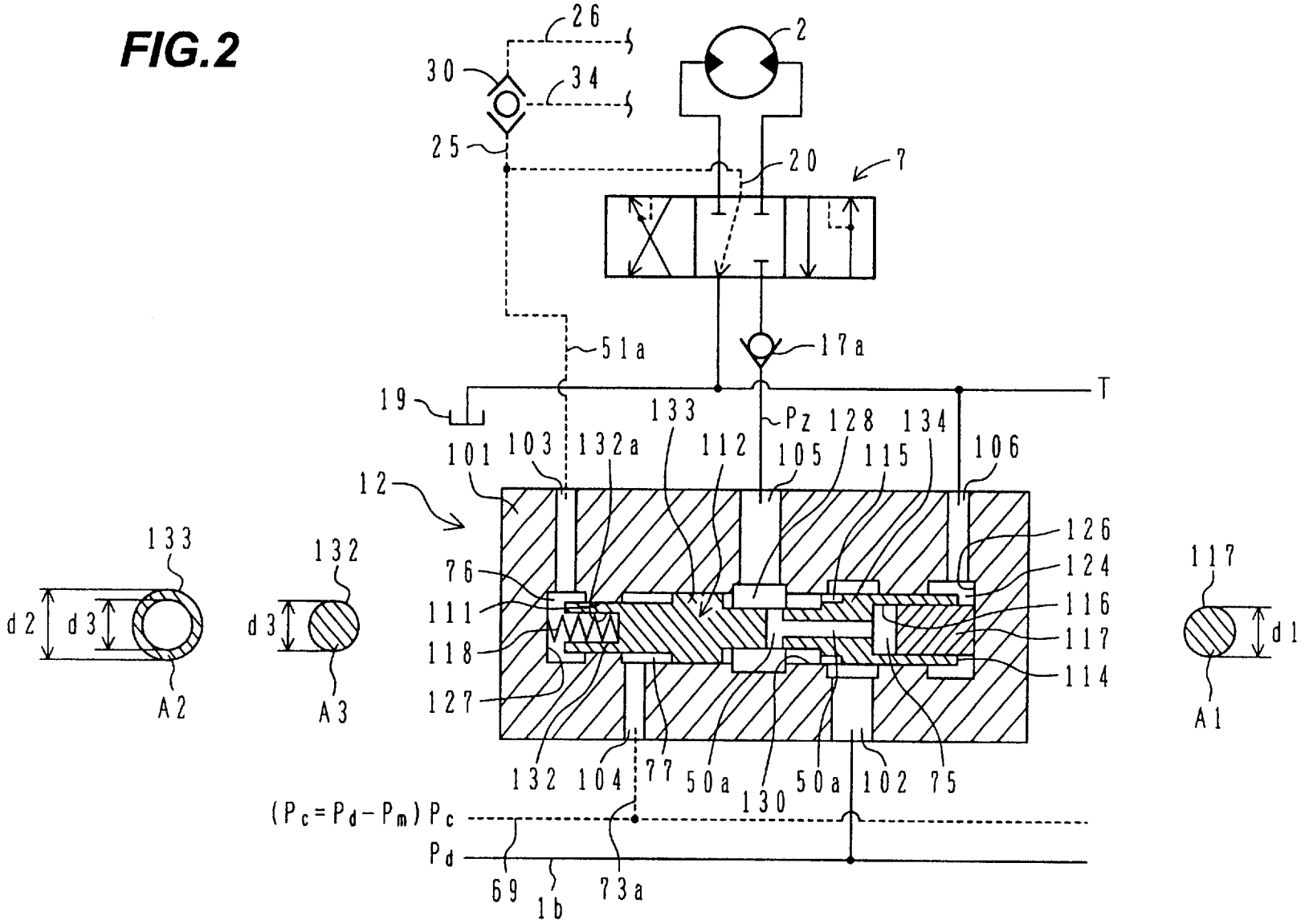
FIG. 2 is a sectional view showing details of the structure of a pressure compensating valve for a swing section.

The structure of the pressure compensating valve 12 is shown in FIG. 2.

Referring to FIG. 2, the pressure compensating valve 12 has a body 101 in which a small-diameter bore 111 and a large-diameter bore 130 communicating with the former are formed. A small-diameter portion 132 of a spool 112 is slidably fitted in the small-diameter bore 111 (having an inner diameter d3), and first and second large-diameter portions 133, 134 of the spool 112 are slidably fitted in the large-diameter bore 130 (having an inner diameter d2). Further, a load pressure port 103, a control pressure port 104, an input port 102, an output port 105, and a reservoir port 106 are formed in the body 101. The load pressure port 103 is communicated with the load-pressure signal line 51*a* and is opened to a fluid chamber (hereinafter referred to as a fluid chamber 76) which is formed at an end of the small-diameter bore 111 and serves as the pressure bearing chamber 76. The control pressure port 104 is communicated with the LS-differential-pressure signal line 73*a* and is opened to a fluid chamber (hereinafter referred to as a fluid chamber 77) which is formed in a stepped portion between the small-diameter portion 132 and the first large-diameter portion 133 of the spool 112 and serves as the pressure bearing chamber 77. The input port 102 is communicated with the pump delivery fluid line 1*b* and is opened to the entry side of a throttle portion 115 which is capable of opening/closing and formed in the second large-diameter portion 134 of the spool 112. The output port 105 is communicated with the load check valve 17*a* and is opened to a fluid chamber 128 formed in the large-diameter bore 130 between the first large-diameter portion 133 and the second large-diameter portion 134 of the spool 112. The reservoir port 106 is communicated with the reservoir 19 and is opened to a fluid chamber 124 formed at an end of the large-diameter bore 130.

A recess 132*a* is formed at an end of the small-diameter portion 132 of the spool 112, and a weak spring 118 for holding a spool position is disposed in the fluid chamber 76 between a bottom surface of the recess 132*a* and a end surface 127 of the small-diameter bore 111.

An axial bore 116 (having an inner diameter d1) is formed at an end surface 114 of the spool 112 at the other end side, and a piston 117 is slidably inserted in the bore 116 in a fluid-tight and telescopic manner. A fluid chamber (hereinafter referred to as a fluid chamber 75) is formed by the bore 116 and one end of the piston 117 to serve as the pressure bearing chamber 75. The other end of the piston 117 is positioned in the fluid chamber 124 and is able to abut with an end surface 126 of the large-diameter bore 130. The fluid chamber 75 is communicated with the output port 105 through a fluid passage which is formed in the spool 12 to serve as the signal line 50*a*.

The pressure bearing area A1 of the fluid chamber 75 is defined by a cross-sectional area of the piston 117, the pressure bearing area A3 of the fluid chamber 76 is defined by a cross-sectional area of the spool small-diameter portion 132, and the pressure bearing area A2 of the fluid chamber 77 is defined by an area resulted from subtracting a cross-sectional area of the small-diameter bore 111 from a cross-sectional area of the large-diameter bore 130, respectively. Then, the aforementioned throttle portion 115 capable of opening/closing to throttle a passage between the output port 105 and the input port 102 is formed in the second large-diameter portion 134 of the spool 112. An output pressure Pz acts in the fluid chamber 75 communicating with the output port 105 to move the spool 112 leftward in FIG. 2, i.e., in a direction to close the throttle portion 115. A load pressure PL acts on the pressure bearing area A3 of the fluid chamber 76 to move the spool 112 rightward in FIG. 2, i.e., in a direction to open the throttle portion 115. An LS-differential-pressure corresponding pressure Pc acts on the pressure bearing area A2 of the fluid chamber 77 to move the spool 112 rightward in FIG. 2, i.e., in the direction to open the throttle portion 115.

When the spool 112 is moved leftward in FIG. 2 through a maximum stroke, a left end surface of the spool 112 abuts with the end surface 127 of the small-diameter bore 111 and the throttle portion 115 is closed. Conversely, when the spool 112 is moved rightward through a maximum stroke, a right end surface 114 of the spool and a right end surface of the piston 117 abuts with the end surface 126 of the large-diameter bore 130 and the throttle portion 115 is fully opened. When the spool 112 is moved through an intermediate stroke, the throttle portion 115 of the spool increases an opening in proportional to an amount of stroke through which the spool has moved rightward.

The outer diameter d3 of the small-diameter portion 132 of the spool 112 is smaller than the outer diameter d1 of the piston 117 (d3<d1) so that the pressure bearing area A3 is smaller than the pressure bearing area A1 (A3<A1). In this embodiment, A3/A1=approximately 0.83 is set. By thus setting the pressure bearing area A3 to be smaller than the pressure bearing area A1, the pressure compensating valve 12 for the swing section is given such a load dependent characteristic that a flow rate passing the directional control valve 7 communicating with the swing motor 2 is reduced depending on an increase in the load pressure (PL) of the swing motor 2. By setting A3/A1=approximately 0.83, in particular, a flow rate characteristic simulating constant-horsepower control is provided as the load dependent characteristic.

Figure 3:
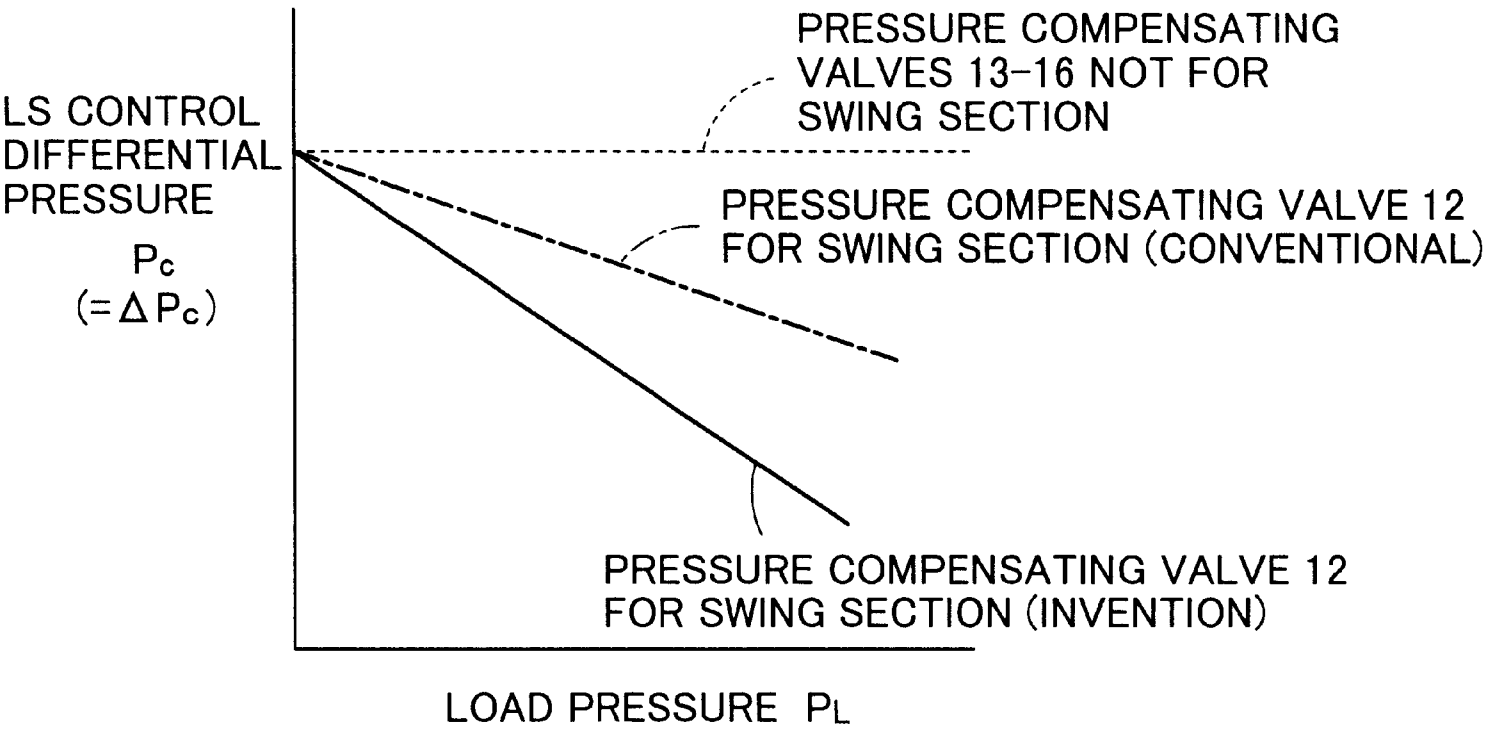
FIG. 3 is a graph showing a load dependent characteristic of the pressure compensating valve for the swing section.

FIG. 3 shows the load dependent characteristic of the pressure compensating valve 12. The horizontal axis of FIG. 3 represents the load pressure denoted by PL, and the vertical axis represents the target compensation differential pressure denoted by ΔPv0. A dotted line indicates, for reference, the target compensation differential pressure of the pressure compensating valves 13–16 not for the swing section, and a one-dot chain line indicates, for comparison, a load dependent characteristic resulted in the case of setting A3/A1=approximately 0.94. In the pressure compensating valves 13–16 not for the swing section, the target compensation differential pressure ΔPv0 is held at the LS-differential-pressure corresponding pressure ΔPc in spite of an increase in the load pressures PL of the associated actuators 3–6. On the other hand, in the pressure compensating valve 12 for the swing section, when the load pressures PL increases, the target compensation differential pressure ΔPv0 is reduced depending on an increase in the load pressure PL. An extent at which the target compensation differential pressure ΔPv0 is reduced is greater than that resulted in the case of setting A3/A1=approximately 0.94, whereby the flow rate characteristic simulating the constant-horsepower control is provided.

Figure 4:
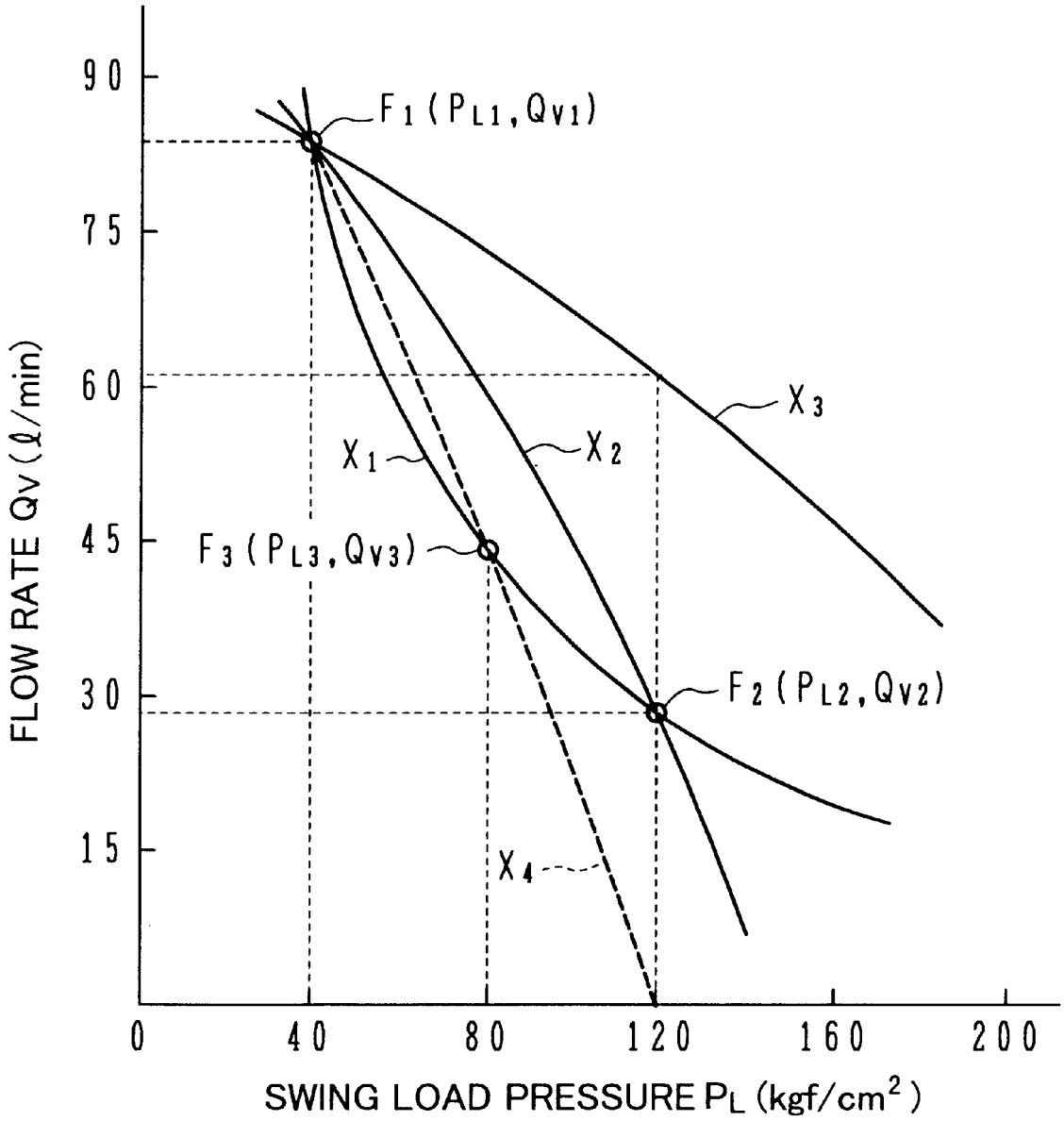
FIG. 4 is a graph showing a practical example of the load dependent characteristic simulating constant-horsepower control of the pressure compensating valve for the swing section.

FIG. 4 shows a practical example of the load dependent characteristic of the pressure compensating valve 12 for the swing section. The horizontal axis of FIG. 4 represents the load pressure (PL) of the swing motor 2, and the vertical axis represents a flow rate (Qv) of the hydraulic fluid controlled by the pressure compensating valve 12 and supplied to the swing motor 2 after passing directional control valve 7. Also, in FIG. 4, a curve X1 indicates a constant-horsepower control characteristic provided by PL·Qv=C (constant), a curve X2 indicates the load dependent characteristic of the pressure compensating valve 12, and a curve X3 indicates, for comparison, the load dependent characteristic of a pressure compensating valve which is constructed to have A3/A1=0.94. A curve X4 indicates a lower limit of the load dependent characteristic in the present invention. These characteristics X1, X2, X3, X4 are based on the following machine specifications.

Applied Model: 4-ton class mini-shovel

Opening area Av of the directional control valve 7: 34.5 ($mm^2$) (full open)

Load pressure PL1 in steady state: 40 ($kgf/cm^2$)

Supply flow rate Qv1 in steady state: 85 (liter/min)

Load pressure PL2 at start-up (swing relief pressure PLmax): 120 ($kgf/cm^2$)

LS-control differential pressure Pc (LS-differential-pressure corresponding pressure): 15 ($kgf/cm^2$)

Assuming that the pressure compensating valve 12 has a characteristic denoted by the constant-horsepower control characteristic curve X1, the pressure compensating valve 12 operates at a point F2 of the load pressure PL2=120 ($kgf/cm^2$) immediately after the swing start-up. Then, when the speed of the swing motor 2 reaches a steady speed, the pressure compensating valve 12 operates at a point F1 of the load pressure PL1=40 ($kgf/cm^2$) and the flow rate Qv1=85 (liter/min). In this case, at the point F2 immediately after the start-up, since the load pressure PL2 is 120 ($kgf/cm^2$), a flow rate Qv2 is approximately 28.3 (liter/min).

In this embodiment, the area difference of A3/A1=0.83 is provided between the pressure bearing area A1 of the pressure bearing chamber 75 and the pressure bearing area A3 of the pressure bearing chamber 76 as described above. In this case, the characteristic line X2 is given as a curve, along which the flow rate Qv is reduced as the load pressure (PL) rises and which passes the two points F1, F2 on the constant-horsepower control characteristic curve X1. Stated otherwise, in this embodiment, the load dependent characteristic of the pressure compensating valve 12 is set such that the flow rate obtained at the load pressure PL2 immediately after the start-up of the swing motor 2 is substantially equal to the flow rate Qv2 which provides a horsepower equal to the horsepower outputted in the steady state of the swing motor 2. The pressure compensating valve 12 is therefore given the flow rate characteristic simulating the constant-horsepower control. As a result, in the state of the load pressure PL2 immediately after the start-up, the swing motor 2 is supplied with a horsepower equal to the horsepower outputted in the steady state thereof.

For comparison, in the case of A3/A1=0.94, the flow rate Qv is reduced as the load pressure (PL) rises as indicated by the curve X3, but a reduction rate is smaller than that indicated by the curve X2 representing this embodiment. The flow rate Qv corresponding to the point F2 immediately after the start-up is not less than 60 (liter/minute), thus resulting in an extra flow rate not less than 30 (liter/minute) as compared with the flow rate at the point F2.

The necessity of keeping PL·Qv=C (constant) will now be described with reference to FIG. 5.

Figure 5:
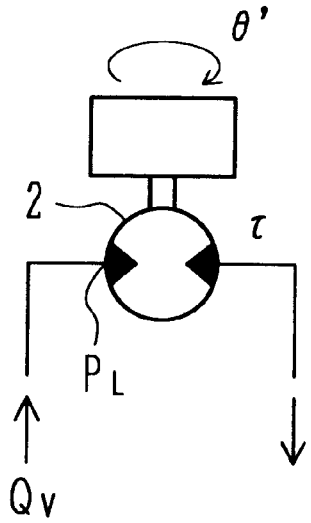
FIG. 5 is a schematic view for explaining necessity of the constant-horsepower control.

In FIG. 5, it is assumed that the angular speed of the swing motor 2 is θ', the torque under pressure corresponding to resistance against rotation of the swing motor 2 is τ, and the load pressure and the supply flow rate of the swing motor 2 are respectively PL and Qv as mentioned above. Also, assuming that the angular speed θ' and the torque τ of the swing motor 2 during steady rotation thereof are respectively θ'1 and τ1, θ'1 and τ1 are given below:

θ'1: corresponding to a control target value (held at a constant value)

τ1: torque under pressure corresponding to resistance against rotation

Energy per unit time is therefore τ1·θ'1. Further, assuming that the load pressure and the supply flow rate of the swing motor 2 during steady rotation thereof are respectively PL1 and Qv1 as mentioned above, the following relationship is obtained:

$$\tau 1 \cdot \theta' 1 = PL1 \cdot Qv1$$

If Qv=Qv1=constant is held during acceleration immediately after the start-up of the swing motor 2, a pressure in the actuator line supplied to the swing motor 2 reaches the relief pressure, thus resulting in PL=Pmax, because the swing speed θ' is small during acceleration. Given a drawn flow rate of the swing motor 2 being Qm (proportional to θ'), therefore, the hydraulic fluid corresponding to a flow rate of Qv1−Qm is drained from the relief valve to the reservoir. Accordingly, an energy loss per unit time during acceleration is given by PLmax (Qv1−Qm).

When the acceleration continues and the swing speed θ' reaches a steady value, the load pressure PL is quickly lowered from PLmax to PL1, whereby the system undergoes oscillation (hunting). At this time, the energy corresponding to (PLmax−PL1)Qv1 per unit time is converted into vibration energy. The following drawbacks are hence resulted:

(1) increase in energy loss→reduction in efficiency (2) oscillation (unstable system)

(3) occurrence of heat and noise

Also, in the case of providing the load dependent characteristic with the area difference of A3/A1=approximately 0.94, there occurs an extra flow rate of about 30 (liter/minute) as described above. Thus, such a load dependent characteristic is effective in suppressing oscillation, but the above problems (1) and (3) are not sufficiently overcome.

By contrast, in this embodiment, the pressure compensating valve 12 for the swing section is given the load dependent characteristic to provide the flow rate characteristic simulating the constant-horsepower control, as described above, so that the energy per unit time supplied to the swing motor 2 in a start-up and acceleration mode coincides with an energy value in the steady state to be eventually reached, i.e., so that there holds:

$$PL \cdot Qv = \tau 1 \cdot \theta' 1 (= PL1 \cdot Qv1) = C(\text{constant})$$

Consequently, at transition from the start-up and acceleration mode to the steady state, energy required for accelerating a swing structure is supplied to the swing motor 2, a lowering of the accelerating performance (acceleration) is prevented, and in addition useless energy is not supplied to the swing motor 2. As a result, the stable swing system with good energy efficiency can be constructed.

Next, an allowable range of the load dependent characteristic will be described.

In the above example, by setting the load dependent characteristic of the pressure compensating valve 12 for the swing section as indicated by the curve X2 in FIG. 4, the flow rate characteristic simulating the constant-horsepower control is provided such that the flow rate resulted at the load pressure PL2 immediately after the start-up of the swing motor 2 is substantially equal to the flow rate Qv2 providing a horsepower equal to the horsepower outputted in the steady state of the swing motor 2, and that the horsepower equal to the horsepower outputted in the steady state can be obtained immediately after the start-up of the swing motor 2. However, the load dependent characteristic of the pressure compensating valve 12 (the flow rate characteristic simulating the constant-horsepower control) may be set to the lower side (direction in which the flow rate is reduced) of the curve X2 in FIG. 4 or the upper side (direction in which the flow rate is increased) thereof within a predetermined range with the curve X2 as a reference.

When the load dependent characteristic of the pressure compensating valve 12 (the flow rate characteristic simulating the constant-horsepower control) is set to the lower side of the curve X2 in FIG. 4, a flow rate resulted at the load pressure PL2 immediately after the start-up is smaller than the flow rate Qv2 providing the horsepower equal to the horsepower outputted in the steady state.

In this embodiment, the reason why the load dependent characteristic of the pressure compensating valve 12 for the swing section is set to provide the flow rate characteristic simulating the constant-horsepower control resides in realizing that the energy per unit time supplied to the swing motor 2 during acceleration coincides with an energy value in the steady state to be eventually reached. The most effective method for that purpose is to make the coincidence achieved immediately after the swing start-up. However, the purpose of setting the load dependent characteristic in the present invention is to reduce an extra flow rate while ensuring the accelerating performance required for the start-up. Even with the load dependent characteristic set to the lower side of the curve X2, there necessarily occurs a condition, in which the energy per unit time supplied to the swing motor 2 coincides with the energy value in the steady state, at any point in an accelerating process immediately after the swing start-up. In that condition, the same advantages as described above can be obtained. Also, in the case of setting the load dependent characteristic of the pressure compensating valve 12 to the lower side of the curve X2, the accelerating performance immediately after the start-up is slightly deteriorated, but the extra flow rate drained from the relief valve to the reservoir is further reduced. Therefore, the effect of reducing an energy loss and the effect of suppressing oscillation, etc. are further increased.

Here, if the point at which the energy per unit time supplied to the swing motor 2 coincides with the energy value in the steady state during the accelerating process is too close to the point F1 representing the steady state, a lowering of the accelerating performance becomes not negligible. It is thought that, when the energy per unit time supplied to the swing motor 2 coincides with the energy value in the steady state until reaching a load pressure PL3 that is substantially middle between the load pressure PL1 in the steady state and the load pressure PL2 immediately after the start-up, the accelerating performance can be provided at a level not causing a problem in practical use. In FIG. 4, the curve X4 indicates such a lower limit of the load dependent characteristic. With the load dependent characteristic indicated by the curve X4, a flow rate resulted at the load pressure PL3, which is substantially middle between the load pressure PL1 in the steady state and the load pressure PL2 immediately after the start-up, is substantially equal to a flow rate Qv3 providing, at the middle load pressure PL3, a horsepower equal to the horsepower outputted in the steady state of the swing motor. Accordingly, it is required that the load dependent characteristic of the pressure compensating valve 12 for the swing section be set not to enter the lower side of the curve X4 (i.e., so that the flow rate resulted at the load pressure PL3, which is substantially middle between the load pressure PL1 in the steady state and the load pressure PL2 immediately after the start-up, is not smaller than the flow rate Qv3 providing, at the middle load pressure PL3, a horsepower equal to the horsepower outputted in the steady state of the swing motor).

Further, when the load dependent characteristic of the pressure compensating valve 12 (the flow rate characteristic simulating the constant-horsepower control) is set to the upper side of the curve X2 in FIG. 4, a flow rate resulted at the load pressure PL2 immediately after the start-up is greater than the flow rate Qv2 providing the horsepower equal to the horsepower outputted in the steady state. However, if the load dependent characteristic of the pressure compensating valve 12 is set to the lower side of the curve X3, the extra flow rate immediately after the start-up is reduced as compared with the conventional case. As a result, the above problems (1) and (3), i.e., a lowering of energy efficiency and the occurrence of heat and noise, are alleviated.

A description is now made of a method of calculating an area difference between the pressure bearing chambers to provide, as the load dependent characteristic of the pressure compensating valve 12 for the swing section, the above-described flow rate characteristic simulating the constant-horsepower control characteristic.

Figure 6:
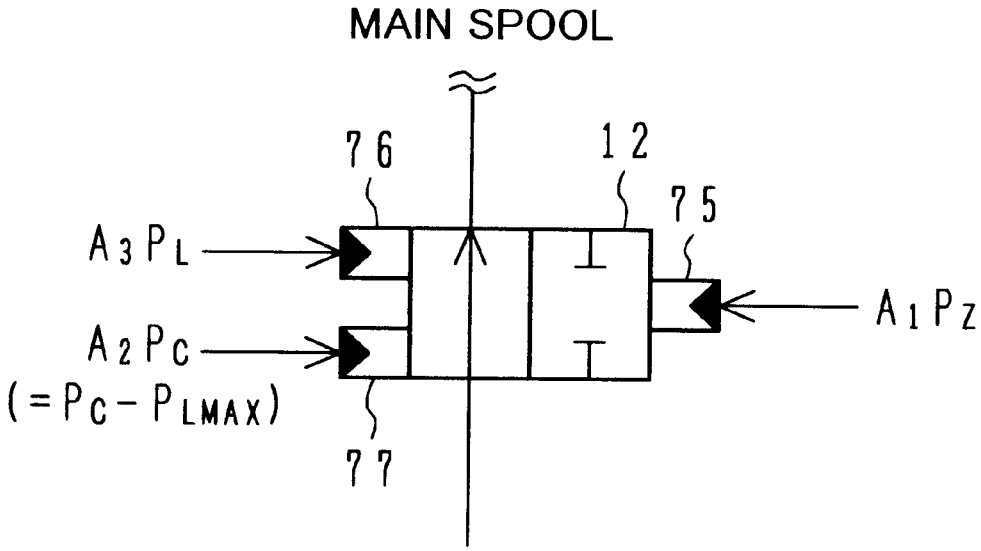
FIG. 6 is a schematic view for explaining a method of calculating an area difference between pressure bearing chambers to give the pressure compensating valve a flow rate characteristic simulating a constant-horsepower control characteristic.

Referring to FIG. 6, when the LS-differential-pressure corresponding pressure Pc acts on the pressure bearing area A2 of the pressure bearing chamber 77, the target compensation differential pressure is given by A2·Pc. The pressure compensating valve 12 functions such that the target compensation differential pressure is balanced by a difference A1·Pz−A3·PL between the hydraulic pressures in the pressure bearing chambers 75 and 76. Specifically, the following formula holds;

$$A2Pc=A1Pz-A3PL \tag{1}$$

where the acting force of the spring 118 is assumed to be so weak as negligible.

Assuming that the differential pressure across a main spool of the directional control valve 7 is ΔPv, the following formulae hold from the above formula (2):

$$\Delta Pv=Pz-PL$$

$$A2Pc+(A3-A1)PL=A1(Pz-PL)$$

Hence:

$$\Delta Pv=Pz-PL=(A2/A1)Pc-(1-A3/A1)PL \tag{2}$$

Replacement of, $$A2/A1=\alpha$$

$$A3/A1=\beta$$

leads to:

$$\Delta Pv=Pz-PL=\alpha Pc-(1-\beta)PL \tag{3}$$

(ΔP=αPc under condition of A3=A1)

In other words, the differential pressure ΔPv across the main spool is affected by the load pressure PL depending on the area difference between the pressure bearing areas A1 and A3 (load dependent characteristic).

Let now consider how to give the pressure compensating valve 12 the load dependent characteristic simulating the constant-horsepower control. An output horsepower of the swing motor 2 can be expressed by:

$$PLQv=const=C \tag{4}$$

It is assumed, as mentioned above, that the flow rate and the load pressure in the steady state are respectively Qv1 and PL1 (C=PL1·Qv1. From $$Qv=cAv\sqrt{((2/\rho)\Delta Pv)} \quad (5)$$

c: flow rate coefficient

Av: opening area of the main spool

ΔPv: differential pressure across the main spool, the following formulae are obtained:

$$PL\cdot cAv\sqrt{((2/\rho)\Delta Pv)}=C$$

$$\Delta Pv=(C/cAv)^2\cdot\rho/2\cdot 1/PL^2 \quad (6)$$

The above formula (6) is approximated by a straight line as follows.

When approximating, by a straight line, the relation formula (6) between ΔPv (differential pressure across the main spool) and PL (load pressure) which satisfy PLQV=C, a gradient ξ of the straight line is calculated from the conditions below.

Specifically, the formula (6) is approximated by a straight line passing two points representing two values of the load pressure PL, i.e., the pressure PL1 in the steady state and the swing relief pressure PL2 (=PLmax). Assuming that the differential pressures across the main spool obtained from the formula (6) at those two points are respectively ΔPv1 and ΔPv2, the gradient ξ of the straight line is given by:

$$\xi=(\Delta Pv2-\Delta Pv1)/(PL2-PL1) \quad (7)$$

Accordingly, the above formula (6) is approximated by a straight line below:

$$\Delta Pv=\Delta Pv1+\xi(PL-PL1)$$

Since ΔPv1 is the differential pressures across the main spool in the steady state, ΔPv1=Pc holds. Hence:

$$\Delta Pv=Pc-\xi PL1+\xi PL \quad (8)$$

From the formulae (3) and (8), the area ratios of the signal pressure bearing chambers 75–77 of the pressure compensating valve 12 are expressed by:

$$-(1-\beta)=\beta-1=(A3/A1)-1=(\Delta Pv2-\Delta Pv1)/(PL2-PL1) \quad (9)$$

$$\alpha = A2/A1 \quad (10)$$

$$= 1-(PL1/Pc)\xi$$

$$= \{1-(PL1/Pc)\}\times(\Delta Pv2-\Delta Pv1)/(PL2-PL1)$$

By way of example, practical values are listed below.

Applied Model: 4-ton class mini-shovel

ρ: 860 (kg/m$^3$)

c: 0.7

Av: 34.5 (mm$^2$)

PL1=40 (kg m$^3$)

Qv1: 85 (liter/min)

Pc: 15 (kgf/cm$^3$)

$$C=PL1Qv1=40\times10^6\times85\times(10^{-3}/60)=5.6\times10^{+3}$$

$$\Delta Pv1=Pc=15\ (\text{kgf/cm}^3)$$

$$\Delta Pv2=(C/cAv)^2(\rho/2)\cdot(1/PL2^2)$$

$$=0.17\times10^6(Pa)$$

$$=1.7\ (\text{kgf/cm}^3)$$

$$PL2=120\ (\text{kg/m}^3)$$

Figure 7:
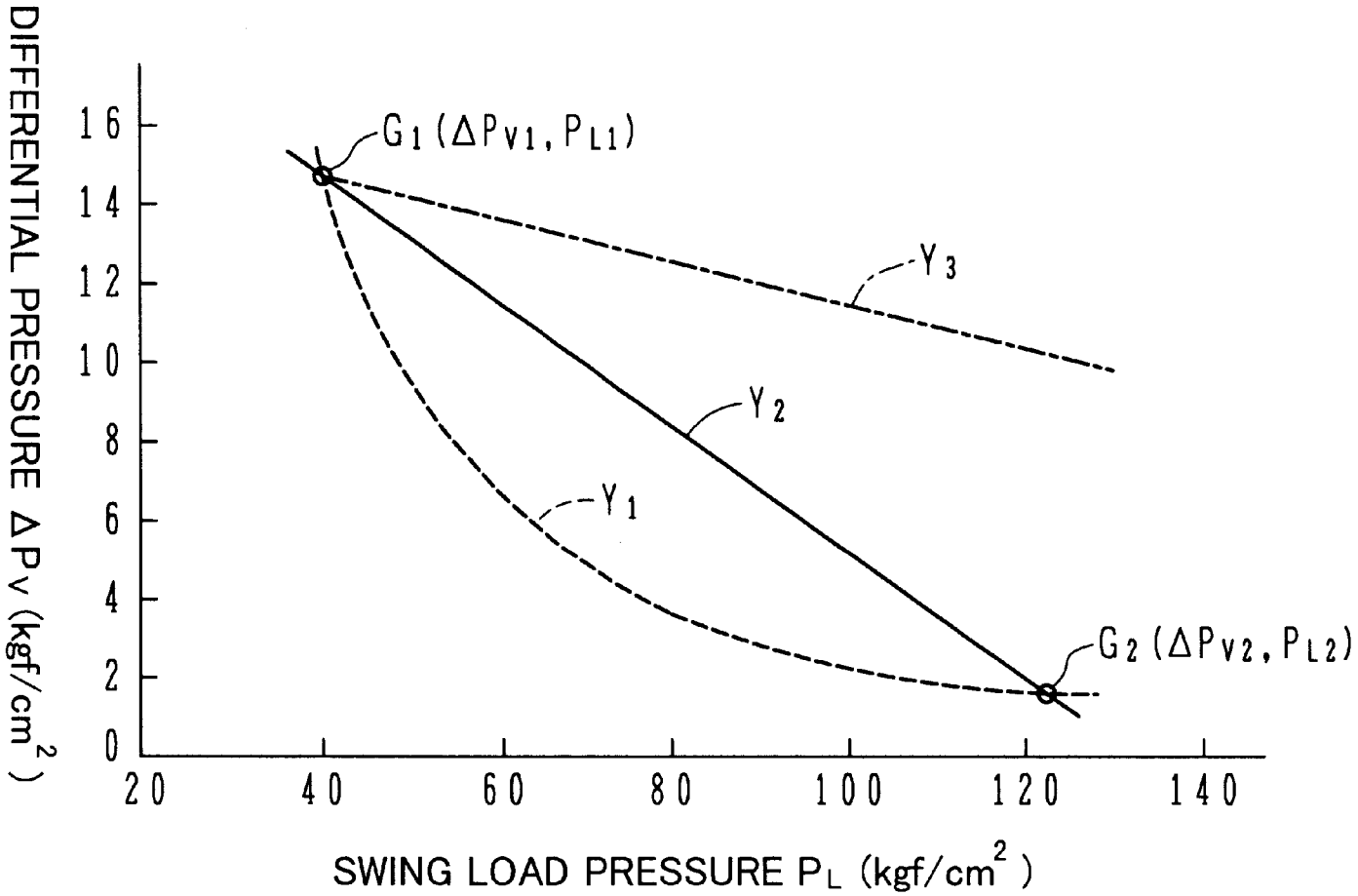
FIG. 7 is a graph showing a constant-horsepower control characteristic effected by the pressure compensating valve and one example of the load dependent characteristic simulating constant-horsepower control in this embodiment, looking from a relationship between a swing load pressure and a differential pressure across a directional control valve.

In FIG. 7, a curve Y1 indicates the formula (6) in the above example, and a straight line Y2 indicates the formulae (3) and (8). A point G1 in FIG. 7 is a point corresponding to the load pressure PL1 in the steady state, and a point G2 is a point corresponding to the load pressure PL2 immediately after the start-up. Y3 is a straight line indicating, for comparison, the load dependent characteristic of the pressure compensating valve in the case of A3/A1=0.94. Those characteristic lines can be plotted as shown in FIG. 4, as described above, in terms of the relationship between the swing load pressure PL and the flow rate Qv.

Calculation $$\beta-1=(\Delta Pv2-\Delta Pv1)/(PL2-PL1) \quad (1)$$

$$=(1.7-15)/(120-40)$$

$$=-1.6\times10^{-1}$$

Hence, β=A3/A1=0.83

(2) α=1−(PL1/Pc)ξ=1−40/15×(−1.6×10$^{-1}$)=1.43

Hence, α=A2/A1=1.43

From the above results, it is understood that the relationship between PL and ΔPv, which is approximated by a straight line and satisfies PLQv=const, cannot be obtained by the conventional case having the area ratio 0.94.

Figure 8:
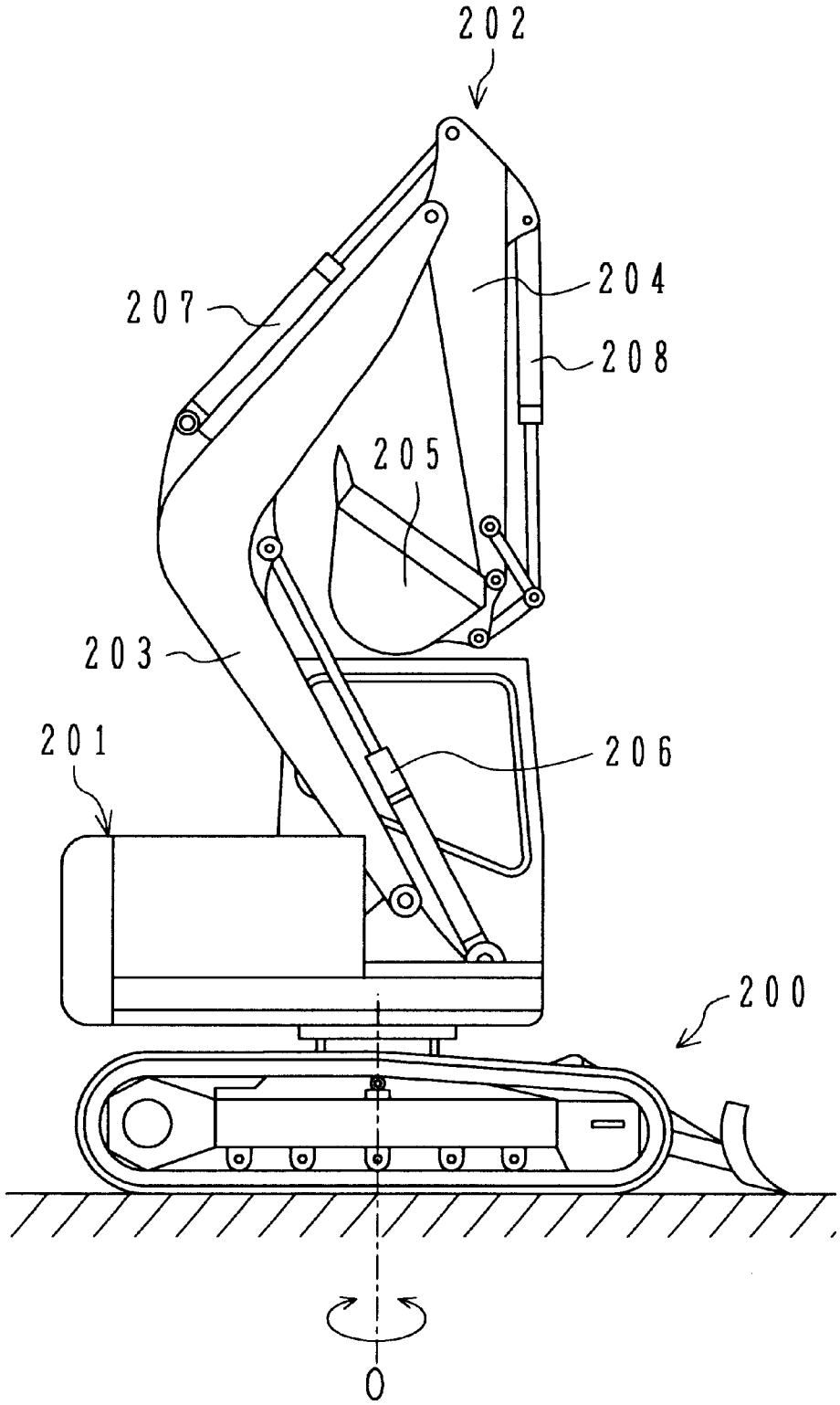
FIG. 8 shows an appearance of a hydraulic excavator to which the hydraulic drive system of the present invention is applied.

The hydraulic drive system described above is installed, for example, in a hydraulic excavator. FIG. 8 shows an appearance of the hydraulic excavator. Referring to FIG. 8, the hydraulic excavator comprises a lower track structure 200, an upper swing structure 201, and a front operating mechanism 202. The upper swing structure 201 is able to swing on the lower track structure 200 about an axis O, and the front operating mechanism 202 is able to move vertically in front of the upper swing structure 201. The front operating mechanism 202 has a multi-articulated structure comprising a boom 203, an arm 204 and a bucket 205. The boom 203, the arm 204 and the bucket 205 are driven respectively by a boom cylinder 206, an arm cylinder 207 and a bucket cylinder 208 for rotation in a plane that contains the axis O. The swing motor 2 shown in FIG. 1 is an actuator for driving the upper swing structure 201 to swing on the lower track structure 200. Three of the other actuators 3–6 are employed as the boom cylinder 206, the arm cylinder 207 and the bucket cylinder 208.

In the above construction, the pressure bearing chamber 77 communicating with the signal line 73*a* of the pressure compensating valve 12 and the pressure bearing chambers 13*c*–16*c* communicating with signal lines 73*b*–73*e* of the pressure compensating valves 13–16 constitute target compensation differential-pressure setting means provided respectively in the plurality of pressure compensating valves 12–16 and setting, as the target compensation differential pressure, the differential pressure between the delivery pressure of the hydraulic pump 1 and the maximum load pressure among the plurality of actuators 2–6. The pressure bearing chambers 75, 76 (having the pressure bearing areas A1>A3) communicating with the signal lines 50*a*, 51*a* of the pressure compensating valve 12 constitute target compensation differential-pressure modifying means provided in the pressure compensating valve 12 of the plurality of pressure compensating valves 12–16, which is associated with the swing section including the swing motor 2, for giving the pressure compensating valve 12 for the swing section such a load dependent characteristic that when the load pressure of the swing motor 2 rises, the target compensation differential pressure of the pressure compensating valve 12 for the swing section among the target compensation differential pressures set by the target compensation differential-pressure setting means is reduced to provide the flow rate characteristic simulating the constant-horsepower control of the swing motor 2.

With this embodiment thus constructed, since the pressure compensating valve 12 for the swing section has the load dependent characteristic, the swing operation can be smoothly accelerated and shifted to the steady state without causing a jerky feel at the start-up in any of swing alone and the combined operation including swing.

More specifically, when a control lever (not shown) for swing is operated to shift the directional control valve 7, the hydraulic fluid from the hydraulic pump 1 is supplied to the swing motor 2 and the swing motor 2 is started up. At the swing start-up, there occurs a rise of the load pressure of the upper swing structure 201 specific to an inertial load. Such a rise of the load pressure is restricted by a safety valve that is constructed by the overload relief valve 60*a* or 60*b* disposed in association with the swing motor 2. The hydraulic fluid supplied to the swing motor 2 is drained in amount corresponding to extra flow rate to the reservoir through the safety valve 60*a* or 60*b*.

In a conventional general pressure compensating valve, an acceleration feel of the upper swing structure 201, which is an inertial load, has been adjusted with drain of the hydraulic fluid through the safety valve. In this case, however, since a flow rate of the hydraulic fluid drawn by the swing motor at the start-up is small, most of the hydraulic fluid is drained to the reservoir, thus resulting in an energy loss. Also, it is difficult to keep balance between LS control of the hydraulic pump and the flow rate compensating function of the pressure compensating valve, causing the operator to feel jerky in the swing operation.

By contrast, this embodiment is free from such a problem because the pressure compensating valve 12 for the swing section has the load dependent characteristic described above.

Specifically, when the load pressure PL rises due to the inertial load at the swing start-up, the load dependent characteristic of the pressure compensating valve 12 enables the target compensation differential pressure ΔPv0 to lower from the LS-differential-pressure corresponding pressure Pc, whereby the supply flow rate Qv to the swing motor 2 is controlled to the flow rate corresponding to the lowered target compensation differential pressure ΔPv0. When the upper swing structure 201 starts rotation and the swing speed rises, the load pressure is gradually reduced while keeping balance between the flow rate drawn by the swing motor 2 and the supply flow rate Qv to the swing motor 2. As a result, the target compensation differential pressure ΔPV0 of the pressure compensating valve 12 also rises.

When the flow rate drawn by the swing motor 2 and the supply flow rate Qv to the swing motor 2 are not balanced, there occurs a rise or fall of the load pressure PL, which is fed back to the pressure compensating valve 12 for the swing section. With the load dependent characteristic of the pressure compensating valve 12, when the supply flow rate Qv is too large, the load pressure PL rises, whereupon the supply flow rate Qv is restricted by the pressure compensating valve 12. Conversely, when the supply flow rate Qv is insufficient, the load pressure PL lowers, whereupon the supply flow rate Qv is increased by the pressure compensating valve 12. As a result of such fine adjustment of the pressure compensating valve 12, the swing motor 2 can be moderately accelerated and shifted to the steady state without causing hunting that has been produced under the conventional LS control.

Suppose now the case where control levers for the swing and the boom are simultaneously operated to start up the swing motor 2 and another actuator, e.g., the actuator 3, at the same time, and the actuator 3 is the boom cylinder. When a total flow rate demanded by the swing and the boom exceeds the maximum delivery rate of the hydraulic pump 1 and saturation occurs, the target compensation differential pressure ΔPv0 of the pressure compensating valves 12, 13 are lowered upon a fall of the LS-control differential pressure ΔPc which is in proportion to a deficiency of the supply flow rate with respect to the total demanded flow rate, and therefore the supply flow rate is distributed again. In the pressure compensating valve 12 for the swing section, since the load pressure PL of the swing motor 2 rises due to the inertial load at the same time as the start-up of the swing motor 2, the target compensation differential pressure ΔPv0 is further lowered with the load dependent characteristic of the pressure compensating valve 12 of the pressure compensating valves 12.

Also, in that case, as a result of the fine adjustment with the load dependent characteristic of the pressure compensating valve 12 for the swing section, the swing motor 2 can be moderately accelerated without causing hunting that has been produced under the conventional LS control.

Furthermore, with this embodiment, since the pressure compensating valve 12 for the swing section is given, as described above, the load dependent characteristic that provides the flow rate characteristic simulating the constant-horsepower control, a necessary accelerating performance (acceleration feel) is ensured and the hydraulic fluid is not supplied to the swing motor 2 at a flow rate exceeding a required level. Accordingly, an amount of the hydraulic fluid drained to the reservoir through the swing safety valve 60*a* or 60*b* during acceleration can be minimized, whereby an energy loss is reduced and the energy efficiency can be improved. It is also possible to suppress oscillation of the swing system for stabilization, and to reduce heat and noise generated.

In the combined start-up operation of the swing and the boom, as described above, the flow rate of the hydraulic fluid supplied to the boom cylinder is reduced due to redistribution of the supply flow rate, which is effected upon the occurrence of saturation. At the same time, the flow rate of the hydraulic fluid supplied to the swing motor 2 is reduced with the load dependent characteristic of the pressure compensating valve 12. The hydraulic fluid corresponding to a reduced supply flow rate to the swing motor 2 is supplied to the boom cylinder 3, and therefore a slow-down of the boom cylinder 3 can be suppressed. In this embodiment, particularly, since the pressure compensating valve 12 for the swing section is given the load dependent characteristic that provides the flow rate characteristic simulating the constant-horsepower control, the hydraulic fluid is not supplied to the swing motor at a flow rate exceeding a required level, and an amount of the hydraulic fluid, which corresponds to an extra flow rate and has been drained to the reservoir through the swing safety valve 60*a* or 60*b* in the conventional system, can be supplied to the boom cylinder 3. Accordingly, more efficient energy distribution than in the conventional system can be achieved.

Further, since the load dependent characteristic for the swing section is set based on the constant-horsepower control as a reference, the best load dependent characteristic for stabilizing the swing system can be easily determined by design calculation once machine specifications are provided.

Additionally, since the above-described function can be achieved without providing a separate circuit for the swing, problems of an increase in cost and space and complicated circuit configuration are avoided.

Figure 9:
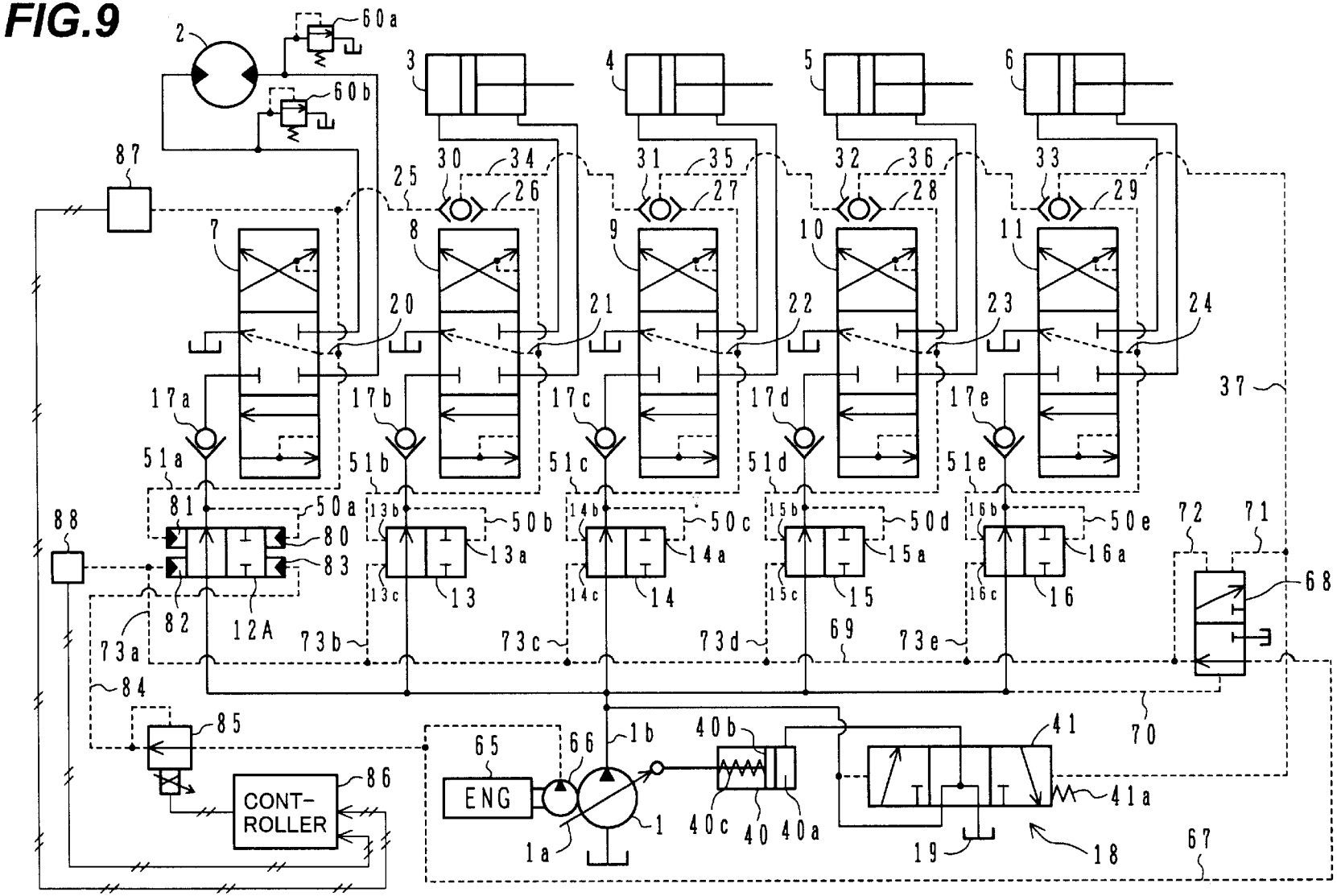
FIG. 9 is a circuit diagram showing a hydraulic drive system according to a second embodiment of the present invention.

A second embodiment of the present invention will be described with reference to FIGS. 9 to 11. In FIG. 9, equivalent members to those shown in FIG. 1 are denoted by the same numerals.

Referring to FIG. 9, a pressure compensating valve 12A for a swing section has a pressure bearing chamber 80 to which a pressure taken out by a signal line 50*a* is introduced and which acts in the valve-closing direction, a pressure bearing chamber 81 to which a pressure taken out by a signal line 51*a* is introduced and which acts in the valve-opening direction, a pressure bearing chamber 82 to which a pressure taken out by a signal line 73*a* is introduced and which acts in the valve-opening direction, and a pressure bearing chamber 83 to which a control pressure in a signal line 84 is introduced and which acts in the valve-closing direction. These pressure bearing chambers 80–83 all have the same pressure bearing area.

The control pressure in the signal line 84 can be produced by a solenoid proportional pressure reducing valve 85 which is operated by a command current from a controller 86. A pressure sensor 87 is provided in a signal line 25 for detecting a load pressure of a swing motor 2, and a pressure sensor 88 is provided in a signal line 69 to which an LS-differential-pressure corresponding pressure Pc is introduced. The controller 86 receives signals from the pressure sensors 87, 88, executes predetermined processing, and outputs the command current to the solenoid proportional pressure reducing valve 85. The solenoid proportional pressure reducing valve 85 is connected to a delivery line 67 of a pilot pump 66, produces a secondary pressure corresponding to the command current by employing, as a primary pressure, a supply pressure of the pilot pump 66, and outputs the secondary pressure, as the control pressure, to the signal line 84.

Figure 10:
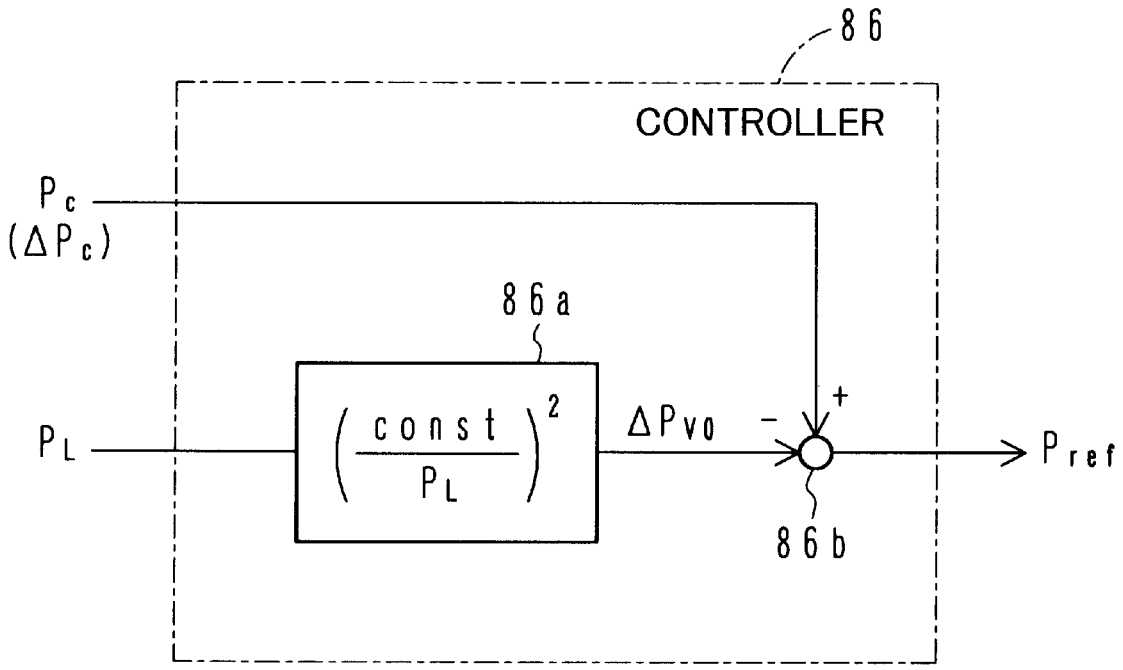
FIG. 10 is a functional block diagram showing a processing function of a controller.

FIG. 10 shows a processing function of the controller 86. The controller 86 comprises target compensation differential-pressure calculating portion 86 for calculating, in accordance with a load pressure PL of the swing motor 2 detected by the pressure sensor 87, a target compensation differential pressure ΔPv0 that provides a flow rate characteristic simulating constant-horsepower control, and a subtracter 86*b* for subtracting the target compensation differential pressure ΔPv0 calculated by the calculating portion 86*a* from the LS-differential-pressure compensating pressure Pc (=LS-control differential pressure ΔPc) detected by the pressure sensor 88. A value calculated by the subtracter 86*b* is used as a target control pressure Pref and a corresponding command current is outputted to the solenoid proportional pressure reducing valve 85. In this way, the controller 86 outputs the command current to the solenoid proportional pressure reducing valve 85 in accordance with the swing load pressure PL from the pressure sensor 87 so that PL·Qv=const is held. Here, Qv is a flow rate of the hydraulic fluid passing the pressure compensating valve 12A for the swing section.

A description is now made of the concept for the above processing executed in the controller 86.

To provide the flow rate characteristic simulating the constant-horsepower control in the swing system, it is required to hold the following relationship:

$$PL \cdot Qv = const \tag{11}$$

Meanwhile, the following relationship exists for a flow rate passing the directional control valve 7:

$$Qv = c \cdot Av \cdot (2/\rho \cdot \Delta Pv)^{1/2} \tag{12}$$

Av: opening area of the directional control valve 7 c: flow rate coefficient

ρ: density of the hydraulic fluid

ΔPv: differential pressure across the directional control valve 7

Assuming here that an amount by which the directional control valve 7 is operated is constant, c, Av and ρ are constants. Putting the formula (12) in the formula (11) results in:

$$PL \cdot c \cdot Av \cdot (2/\rho \Delta Pv)^{1/2} = \text{const}$$

Hence:

$$PL \cdot \Delta Pv^{1/2} = \text{const} \tag{13}$$

The proportional constant depends on various attributes of the applied machine. In the above formula, ΔPv is the target compensation differential pressure of the pressure compensating valve 12A. The root of the target compensation differential pressure is reduced in reverse proportion to the load pressure, and therefore the flow rate passing the directional control valve 7 is also in reverse proportion relation to the load pressure from the relationship of the formula (12).

On the other hand, since the target compensation differential pressure of the pressure compensating valve 12A is given by the LS-control differential pressure ΔPc in a steady state where the load pressure is lowered to a normal level, the target control pressure Pref of the solenoid proportional pressure reducing valve 85 is provided by:

$$Pref = \Delta Pc - (\text{const}/PL)^2 \tag{14}$$

The calculating portions 86*a*, 86*b* of the controller 86, shown in FIG. 10, execute the processing represented by the formula (14). By introducing the thus-obtained control pressure from the solenoid proportional pressure reducing valve 85 to the pressure bearing chamber 83 of the pressure compensating valve 12A, the relationship of the formula (11) can be held for the swing system.

Figure 11:
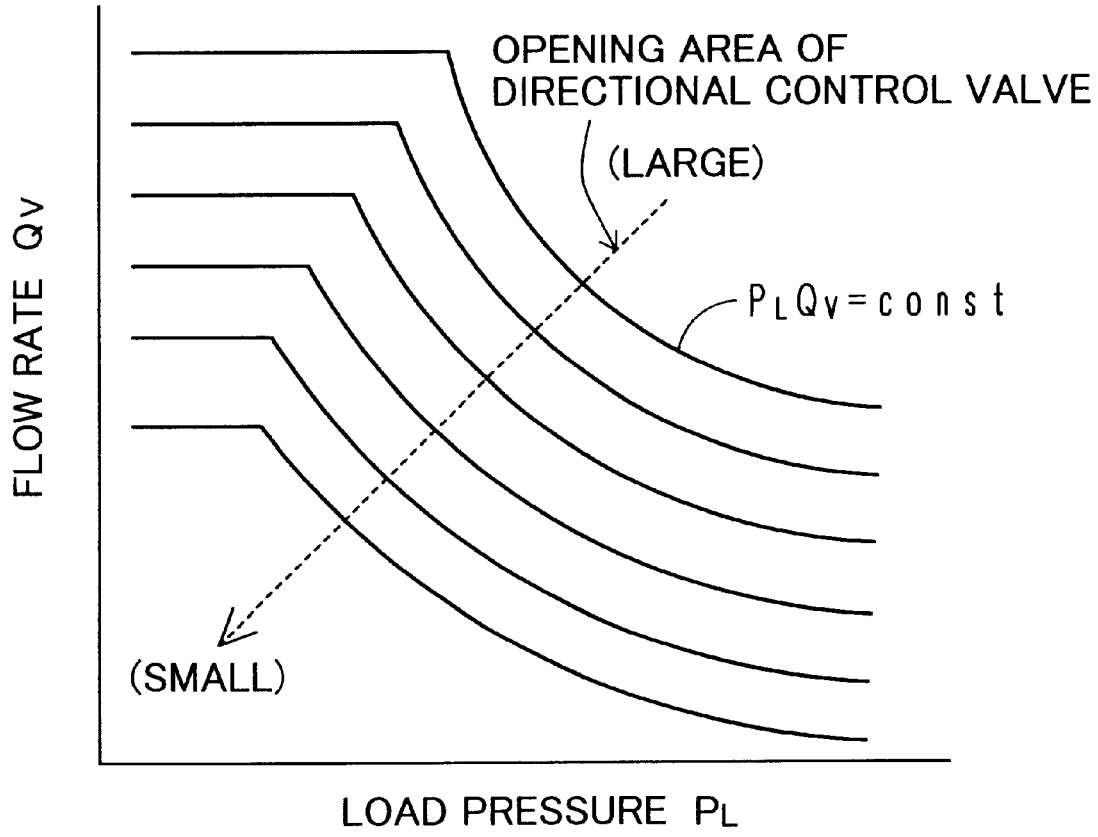
FIG. 11 is a graph showing flow rate characteristics of the pressure compensating valve for the swing section.

As a result, flow rate characteristics of the pressure compensating valve 12A for the swing section are given as shown in FIG. 11, whereby the swing system can be smoothly shifted to a steady rotation state without supplying useless excessive energy to the swing system at the swing start-up.

In the above construction, the pressure bearing chamber 82 communicating with the signal line 73*a* of the pressure compensating valve 12A and the pressure bearing chambers 13*c*–16*c* communicating with signal lines 73*b*–73*e* of the pressure compensating valves 13–16 constitute target compensation differential-pressure setting means provided respectively in the plurality of pressure compensating valves 12A–16 and setting, as the target compensation differential pressure, the differential pressure between the delivery pressure of the hydraulic pump 1 and the maximum load pressure among the plurality of actuators 2–6. The pressure bearing chamber 83 communicating with the signal line 84 of the pressure compensating valve 12A, the solenoid proportional pressure reducing valve 85, the controller 86, and the pressure sensors 87, 88 constitute target compensation differential-pressure modifying means provided in the pressure compensating valve 12A of the plurality of pressure compensating valves 12A–16, which is associated with the swing section including the swing motor 2, for giving the pressure compensating valve 12A for the swing section such a load dependent characteristic that when the load pressure of the swing motor 2 rises, the target compensation differential pressure of the pressure compensating valve 12A for the swing section among the target compensation differential pressures set by the target compensation differential-pressure setting means is reduced to provide the flow rate characteristic simulating the constant-horsepower control of the swing motor 2.

This embodiment can also provide similar advantages as with the first embodiment.

While each of the above embodiments employs, by way of example, a before-orifice type pressure compensating valve which is positioned upstream of a directional control valve, a system having the same advantage can also be constructed by using an after-orifice type pressure compensating valve which is positioned downstream of a directional control valve.

Also, in each of the above embodiments, the differential pressure between the delivery pressure of the hydraulic pump and the maximum load pressure among the plurality of actuators is set, as the target compensation differential pressure, by providing a differential pressure producing valve that produces a secondary pressure corresponding to the delivery pressure of the hydraulic pump and the maximum load pressure among the plurality of actuators, and introducing an output side pressure of the differential pressure producing valve to one end of the spool of the pressure compensating valve, which acts in the valve-opening direction. However, the pump delivery pressure and the maximum load pressure may be separately introduced to opposite ends of the spool of the pressure compensating valve.

Industrial Applicability

According to the present invention, in a hydraulic drive system including an LS system, since a pressure compensating valve for a swing section is given a load dependent characteristic, the swing operation can be smoothly accelerated and shifted to a steady state without causing a jerky feel at the start-up in any of swing alone and the combined operation including swing.

Also, since the pressure compensating valve for the swing section is given a load dependent characteristic that provides a flow rate characteristic simulating constant-horsepower control, the swing start-up can be realized with a reduced energy loss and improved energy efficiency. It is also possible to suppress oscillation of a swing system for stabilization, and to reduce heat and noise generated.

Further, the best load dependent characteristic for stabilizing the swing system can be easily determined by design calculation depending on machine specifications.

Additionally, since the above-described function can be achieved without providing a separate circuit for the swing, problems of an increase in cost and space and complicated circuit configuration are avoided.

What is claimed is:

1. A hydraulic drive system comprising a hydraulic pump, a plurality of actuators, including a swing motor, which are driven by a hydraulic fluid delivered from said hydraulic pump, a plurality of directional control valves for controlling respective flow rates of the hydraulic fluid supplied from said hydraulic pump to said plurality of actuators, a plurality of pressure compensating valves for controlling respective differential pressures across said plurality of directional control valves, and pump control means for load sensing control to control a pump delivery rate such that a delivery pressure of said hydraulic pump is held at a predetermined value higher than a maximum load pressure among said plurality of actuators, wherein said hydraulic drive system further comprises target compensation differential-pressure setting means provided respectively in said plurality of pressure compensating valves and setting, as a target compensation differential pressure, a differential pressure between the delivery pressure of said hydraulic pump and a maximum load pressure among said plurality of actuators, and target compensation differential-pressure modifying means provided in one pressure compensating valve of said plurality of pressure compensating valves, which is associated with a swing section including said swing motor, for giving the pressure compensating valve for the swing section such a load dependent characteristic that when the load pressure of said swing motor rises, the target compensation differential pressure of the pressure compensating valve for the swing section, which is set by the target compensation differential-pressure setting means, is reduced to provide a flow rate characteristic simulating a constant-horsepower control to maintain a horsepower outputted in a steady operating state of said swing motor.

2. A hydraulic drive system according to claim 1, wherein the flow rate characteristic simulating the constant-horsepower control is such a characteristic that a flow rate which results at a load pressure immediately after start-up of said swing motor is substantially equal to a flow rate providing a horsepower equal to the horsepower outputted in said steady operating state of said swing motor.

3. A hydraulic drive system according to claim 1, wherein the flow rate characteristic simulating the constant-horsepower control is such a characteristic that a flow rate which results at a load pressure immediately after start-up of said swing motor is substantially equal to a flow rate in a predetermined range set with a flow rate, as a reference, providing a horsepower equal to the horsepower outputted in said steady operating state of said swing motor.

4. A hydraulic drive system according to claim 3, wherein the flow rate characteristic simulating the constant-horsepower control is such a characteristic that a flow rate which results at a load pressure, which is substantially middle between the load pressure in the steady state and the load pressure immediately after the start-up, is not smaller than a flow rate providing a horsepower equal to the horsepower outputted in said steady operating state of said swing motor.

5. A hydraulic drive system according to claim 1, wherein the pressure compensating valve for the swing section has signal pressure bearing chambers on which an input side pressure and an output side pressure of the directional control valve for the same swing section act respectively as signal pressures, and said target compensation differential-pressure modifying means is constructed by providing an area difference between said signal pressure bearing chambers of the pressure compensating valve for the swing section and setting a pressure bearing area ratio between said signal pressure bearing chambers to provide said flow rate characteristic.

6. A hydraulic drive system according to claim 1, wherein said target compensation differential-pressure modifying means comprises:

means for detecting a load pressure of said swing motor, a controller for calculating a target flow rate corresponding to the detected load pressure based on a preset constant-horsepower control characteristic, and outputting a control signal corresponding to the calculated target flow rate, and means operated by said control signal for modifying the target compensation differential pressure of the pressure compensating valve for the swing section so that said target flow rate is obtained.

* * * * *

UNITED STATES PATENT AND TRADEMARK OFFICE

CERTIFICATE OF CORRECTION

PATENT NO. : 6,408,622 B1
DATED : June 25, 2002
INVENTOR(S) : Tsuruga et al.

It is certified that error appears in the above-identified patent and that said Letters Patent is hereby corrected as shown below:

Title page,
Item [22], please change the PCT Filed date to -- [22] Dec. 27, 1999 --.

Signed and Sealed this

Fifth Day of November, 2002

*Attest:*

*Attesting Officer*

JAMES E. ROGAN
*Director of the United States Patent and Trademark Office*